US006019046A

United States Patent [19]

Rodi

[11] Patent Number: 6,019,046

[45] **Date of Patent: *Feb. 1, 2000**

[54] PRINTING PRESS WITH REPLACEABLE UNITS ALLOWING FOR DIFFERENT METHODS OF PRINTING

[76] Inventor: Anton Rodi, Karlsruher Strasse 12, D-69181 Leimen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/631,621

[22] Filed: Apr. 10, 1996

[30] Foreign Application Priority Data

Apr. 10, 1995 [DE] Germany ..... 195 13 536

[51] Int. Cl.[7] ..... B41F 3/48; B41F 13/00

[52] U.S. Cl. ..... 101/479; 101/214; 101/229; 101/DIG. 43; 347/108

[58] Field of Search ..... 101/268, DIG. 43, 101/214, 215, 216, 217, 229, 479; 347/108

[56] References Cited

U.S. PATENT DOCUMENTS

| | | | |
|---|---|---|---|
| 3,842,738 | 10/1974 | Terrazas et al. | 101/317 |
| 4,098,185 | 7/1978 | Davidson, Jr. | 101/137 |
| 4,434,715 | 3/1984 | McHenry | 101/72 |
| 4,611,799 | 9/1986 | Nuttin | 270/52.5 |
| 4,739,606 | 4/1988 | Cantile | 101/72 |
| 4,805,501 | 2/1989 | Nuttin | 83/300 |
| 4,854,231 | 8/1989 | Jahn | 101/177 |
| 5,117,610 | 6/1992 | Harman et al. | 101/DIG. 43 |
| 5,213,042 | 5/1993 | Larios | 101/450.1 |
| 5,258,809 | 11/1993 | Wiedemer | 347/115 |

FOREIGN PATENT DOCUMENTS

| | | |
|---|---|---|
| 0 017 720 | 10/1983 | European Pat. Off. . |
| 0 264 347 | 4/1988 | European Pat. Off. . |
| 0 295 606 | 12/1988 | European Pat. Off. . |
| 0 471 874 A1 | 2/1992 | European Pat. Off. . |
| 1 234 736 | 8/1967 | Germany . |
| 42 02 723 | 9/1992 | Germany . |
| 43 27 212 | 2/1995 | Germany . |
| 43 28 058 | 2/1995 | Germany . |
| 2 254 448 | 10/1992 | United Kingdom . |

OTHER PUBLICATIONS

Harcourt, Copier/Offset Architecture, Xerox Dixlosure Journal, vol. 12, No. 4, p. 199, Aug. 1987.

*Primary Examiner*—Edgar Burr
*Assistant Examiner*—Daniel J. Colilla
*Attorney, Agent, or Firm*—Herbert L. Lerner; Laurence A. Greenberg

[57] ABSTRACT

System for producing three-dimensional structures on a substrate, including a machine frame having mounted thereon a replaceable unit for producing a three-dimensional structure on a substrate by a given method, a feeder and a delivery for the substrate, and at least one transport device for transporting the substrate from the feeder to the delivery device via the unit for producing the three-dimensional structure, including an electronic data processor for controlling the replaceable unit for producing the three-dimensional structure and, optionally, the transport device, and another replaceable unit for producing a three-dimensional structure on the substrate by a method which differs from the given method, the other replaceable unit for producing a three-dimensional structure on the substrate by the method which differs from the given method being mountable on the machine frame in exchange for the unit for producing a three-dimensional structure on the substrate by the given method.

10 Claims, 2 Drawing Sheets

PRINTING PRESS WITH REPLACEABLE UNITS ALLOWING FOR DIFFERENT METHODS OF PRINTING

BACKGROUND OF THE INVENTION

1. Field of the Invention

The invention relates to a system for producing imprinted three-dimensional structures on a substrate, including a machine frame having mounted thereon a replaceable unit for producing a three-dimensional structure on a substrate by a given method, a feeder and a delivery for the substrate, and at least one transport device for transporting the substrate from the feeder to the delivery device via the unit for producing the three-dimensional structure.

The production of three-dimensional structures on a substrate having two dimensions in the substrate plane and a generally considerably smaller dimension perpendicular to the substrate, in the context of the invention of the instant application, is understood as being effected by printing techniques; however, related techniques are also used for producing script or pictures on a substrate such as paper, for example.

Conventional printing presses or printers are confined to respective specific methods of printing, such as, offset printing, gravure printing, ink jet printing and so forth. This has its roots in the historical development of printing presses and printers, and it is generally taken for granted that each printing press or printer is limited to its own specific printing method.

In a planographic printing press as described in the published German Patent Document DE-OS 43 28 058, which has the characteristic features mentioned in the introduction hereto, one or more cylinders, on the one hand, and a printing form, on the other hand, are respectively replaceable with an identically constructed unit. To this printing press, too, only one specific printing method is applicable, namely offset printing.

SUMMARY OF THE INVENTION

It is accordingly an object of the invention of the instant application to provide, in general, a system for producing three-dimensional structures on a substrate, i.e., a printing press or printer, which is more universally usable than in prior art. With the foregoing and other objects in view, there is provided, in accordance with the invention, a system for producing three-dimensional structures on a substrate, including a machine frame having mounted thereon a replaceable unit for producing a three-dimensional structure on a substrate by a given method, a feeder and a delivery for the substrate, and at least one transport device for transporting the substrate from the feeder to the delivery device via the unit for producing the three-dimensional structure, comprising an electronic data processor for controlling the replaceable unit for producing the three-dimensional structure and, optionally, the transport device, and another replaceable unit for producing a three-dimensional structure on the substrate by a method which differs from the given method, the other replaceable unit for producing a three-dimensional structure on the substrate by the method which differs from the given method being mountable on the machine frame in exchange for the unit for producing a three-dimensional structure on the substrate by the given method.

In accordance with another feature of the invention, the machine frame has a plurality of stations for accepting the units for producing a three-dimensional structure, respectively, the units being respectively mountable on and removable from each of the stations on the machine frame.

In accordance with a further feature of the invention, the system includes at least one of a substrate turning unit, a substrate further-transporting and a substrate perforating unit, respectively, mountable on the machine frame in place of one of the units for producing a three-dimensional structure.

In accordance with an added feature of the invention, the at least one of the feeder and the delivery is removable from the machine frame, and at least one of the turning and the further-transporting units is mountable on the machine frame, and including another machine frame substantially like the first-mentioned machine frame and being couplable therewith via the at least one of the turning and further-transporting units.

In accordance with an additional feature of the invention, the electronic data processor processes data representing the three-dimensional structures and is connected to at least one of the units for producing a three-dimensional structure so that the respective unit receives the respective data from the electronic data processor for producing the three-dimensional structure based upon the data.

In accordance with yet another feature of the invention, the units for producing respective three-dimensional structures on a substrate are printing units operating in accordance with different printing methods.

In accordance with a concomitant feature of the invention, the printing units, respectively, are selected from the group consisting of ink jet, electrophotographic, offset and gravure printing units.

In the simplest embodiment of the invention, only one unit for producing a three-dimensional structure is mounted on the machine frame and, by replacing this unit with another, a different method of structure production can be performed with the same system. For example, an ink jet printing unit can be replaced by a gravure printing unit. This not only results in a considerably wider spectrum of use, but rather, is also very economical, because all other system units are maintained and can be optimally utilized. Furthermore, the user does not have to keep all available printing units in store but can acquire them when needed.

In a further embodiment of the invention, multiple positions or stations are provided on the machine frame for receiving units for three-dimensional structure production, these various units being respectively mountable on and removable from each of the positions or stations of the machine frame.

In this way, various printing methods can be performed in one and the same machine. For example, one side of a paper sheet may be printed in ink-jet print, while the other side thereof may be printed in offset print. This increases profitability, for example, when specific pages have to be printed individually, in the case of a high-number print run.

Furthermore, in this embodiment of the invention, only one of the methods can be performed while the units provided for the other methods are running idle and, without any change-over, it is possible to switch or convert from one method to the other, merely by controlling the data processor.

Moreover, various units for three-dimensional structure production, for example, ink jet printing units, electrophotographic printing units, offset printing units or gravure printing units, in random order, may be arranged in series or tandem. If multi-color printing is desired, several identical printing units can be arranged behind one another. In some space-saving printing systems, units for simultaneously printing in multiple colors may be used, such as a multi-color ink-jet printing unit, for example, which may be combined, in turn, with other units.

This embodiment of the invention also shows a very favorable relationship between cost and performance, inasmuch as the machine frame, the feeders and deliveries, the transporters and the data processor must only be provided once and are used in all machine configurations.

As can be concluded from what is described hereinbefore, the printing methods used can be quite different from one another. Nevertheless, the various printing units are replaceable and commonly operatable, respectively, without many manual interventions or adjustments, because the printing units are controlled by an electronic data processor, with which they are connected, for example, by standard plug connectors. However, this requires an individual drive controllable by the data processor for each printing unit. Whereas, in the case of offset printing units or gravure printing units, for example, the data processor controls cylinder rotation, inking, and so forth, in the case of ink-jet printing units or electrophotographic printing units, it also provides data representing the three-dimensional structures suitable for the then used printing unit. The connection between the data processor and the printing units not only includes control lines, but also lines for automatically identifying the printing units in operation.

In a further development of the invention, additional aggregate units or components are provided which, in place or exchange of a printing unit, are mountable on the machine frame at a respective position or station thereof, and which can also be controlled by the data processor, if necessary. Suitable additional aggregates are, for example, a turning unit for turning the substrate between two printing units, a transport unit for the further transport of the substrate at positions or stations not occupied by printing units, and a perforating unit for perforating the substrate.

Furthermore, the machine frame can be constructed in a manner that, for example, the delivery is removable from the machine frame and, in place thereof, a transport unit or a turning unit is mountable thereon via which the machine frame can be coupled to a further machine frame from which the feeder is removed. A modular assembly system is thereby created which permits any number of printing units to be arranged in tandem or series and suitably operated. Other features which are considered as characteristic for the invention are set forth in the appended claims.

Although the invention is illustrated and described herein as embodied in a system for producing three-dimensional structures on a substrate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
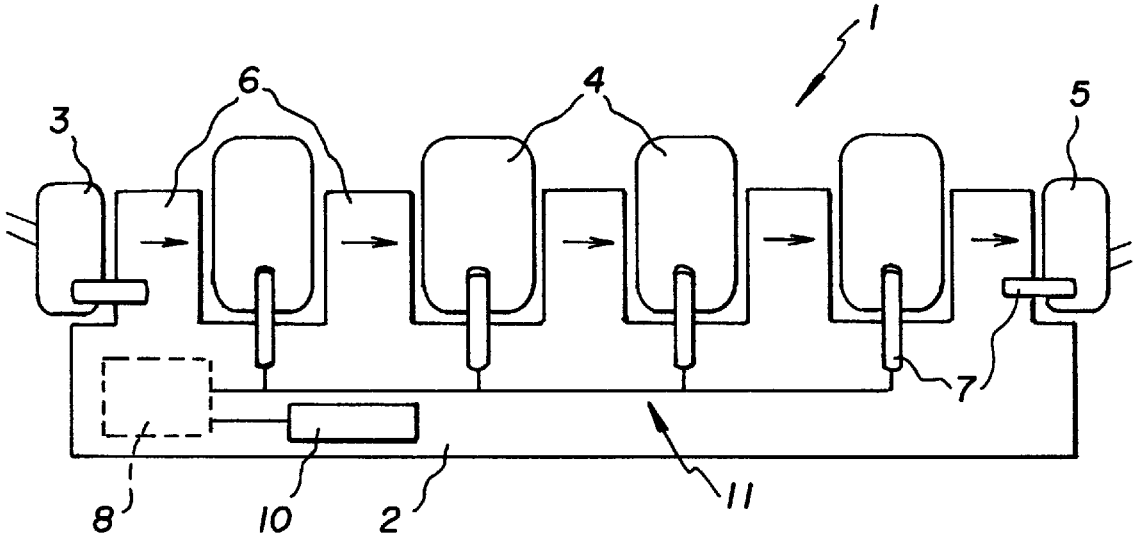
FIG. 1 is a diagrammatic and schematic side elevational view of a modular assembly of a printing press exemplifying the system for producing three-dimensional structures on a substrate in accordance with the invention.

Referring now to the drawing and, first, particularly to FIG. 1 thereof, there is shown therein a printing press 1 having a machine frame 2 with six positions or stations located thereon in mutually spaced relationship behind one another, i.e., in tandem or series, and a paper feeder 3, four printing units 4 and a paper delivery 5 arranged in that order in the respective positions or stations. The paper feeder 3, the delivery 5 and the printing units 4 are connected to one another through paper transport devices 6, as diagrammatically illustrated in FIG. 1, the paper transport devices 6 transporting non-illustrated paper sheets from the paper feeder 3 through the printing units 4 to the paper delivery 5.

The printing units 4, the paper feeder 3 and the delivery 5 are connected by suitable plug connectors 7 to a power supply unit 10 located in the machine frame 2, as well as to a data processor 8, shown diagrammatically in broken lines, which may be arranged within or outside of the machine frame 2.

The printing units 4 are constructed so as to be removable from the machine frame 2 and to be exchangeable with one another. Five types of printing units are indicated by the symbols in FIG. 2 are exchangeable with one another, a one-color ink-jet printing unit 4*a*, a multi-color ink-jet printing unit 4*b*, an electrophotographic printing unit 4*c*, an offset printing unit 4*d* and a gravure printing unit 4*e*.

Figure 2:
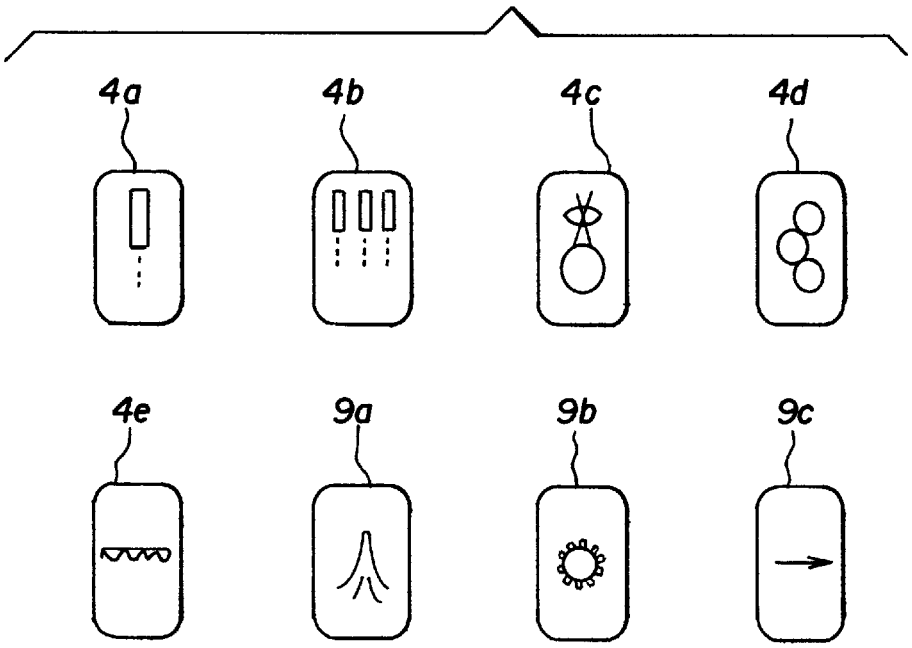
FIG. 2 is an illustration of a selection of various printing units and additional aggregate units or components for the printing press of FIG. 1, the printing units and aggregate units being identified by respective symbols.

Furthermore, as also shown symbolically in FIG. 2, the following three additional aggregate units or components 9*a* to 9*c* are constructed so as to be usable in place of or in exchange for a printing unit 4 at a respective position or station of the machine frame 2, namely:

a turning unit 9*a* for turning the paper sheets, a perforating unit 9*b* for perforating the paper sheets, and a transport unit 9*c* for conveying the paper sheet from one paper transport device 6 to others, when the station on the machine frame 2 located therebetween is unoccupied.

Figure 3:
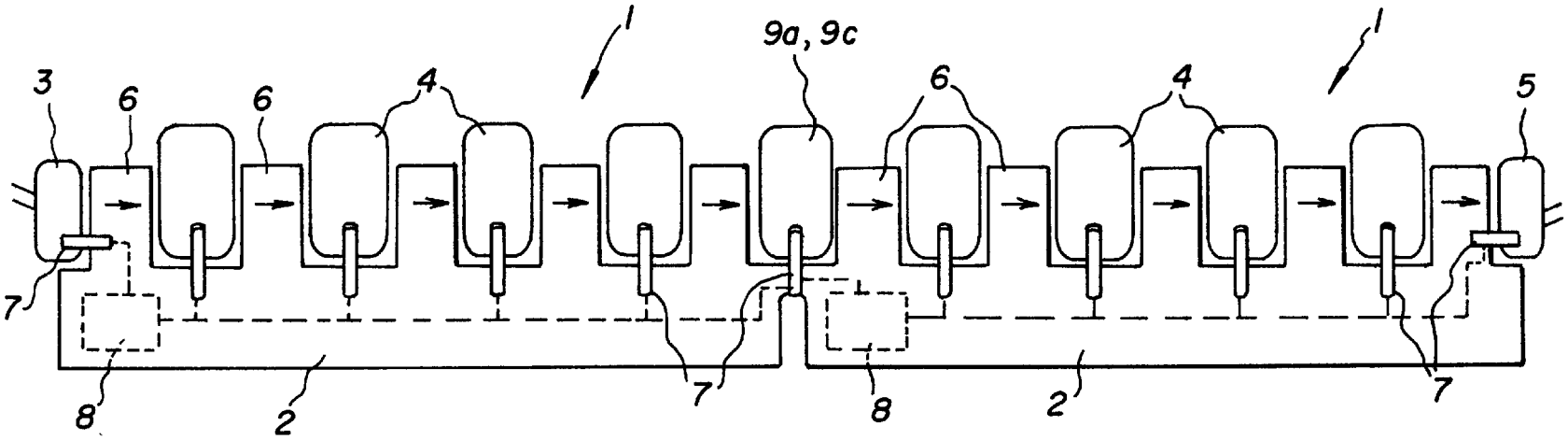
FIG. 3 is a diagrammatic and schematic side elevational view of two printing presses arranged in tandem coupled to one another via a turning unit or a transport unit.

The paper feeder 3 and the delivery 5, as well as the printing units 4, are removable from the machine frame 2, and the machine frame 2 is constructed in a manner that two printing presses 1 arranged in tandem can be coupled to one another via a turning unit 9*a* or a transport unit 9*c* which is positioned in place of the intermediately disposed paper delivery 5 and feeder 3; as shown in FIG. 3.

If, for example, a multi-color ink-jet printing unit 4*b* and three gravure printing units 4*e* for three different colors are installed on a machine frame 2, the printing press 1 is operated as follows:

The data processor 8 controls the paper feeder 3, the delivery 5 and the paper transport devices 6, in order to transport paper sheets in accordance with a press cycle through the printing press 1. The printing units 4*b* and 4*e* are controlled in accordance with the press cycle to transfer printing images onto the paper, the ink-jet printing unit 4*b* receiving properly processed image information of the printing images from the data processor 8 via line 11. The ink-jet printing unit 4*b* and the three gravure printing units 4*e* are equipped for printing on mutually opposite sides of the sheets, so that the sheets may receive a multi-color gravure print on the one side thereof and a multi-color ink-jet print on the other side thereof, the printing image of the ink-jet print being additionally able to be varied from sheet to sheet by means of the data processor 8.

A multiplicity of possible combinations of the printing units 4*a* to 4*e* and the additional aggregate units or components 9*a* to 9*c* noted hereinabove function in a similar manner. If this potential of combinations is limited because, for example, the positions or stations on the machine frame 2 are occupied by four identical printing units for one-side four-color printing, then a further machine frame 2 can simply be added, for example, via the turning device 9*a*, and the other side of the sheet can be printed on the further machine frame 2 in accordance with any desired method. In this regard, either the data processor 8 of both of the printing presses 1 coupled in tandem arrangement are synchronized with one another, or only one data processor 8 controls all of the printing units 4 of both presses 1.

I claim:

1. System for producing three-dimensional, imprinted structures on a substrate, comprising:

a sheet-fed printing press having a machine frame, said machine frame including a plurality of stations;

a replaceable unit selected from the group consisting of a printing unit operating in accordance with a first printing method, a substrate turning unit, a substrate further-transporting unit and a substrate perforating unit mounted on one of said stations of said machine frame for producing a three-dimensional, imprinted structure on a substrate;

a feeder and a delivery for the substrate mounted on said machine frame;

at least one transport device mounted on said machine frame for transporting the substrate from said feeder to said delivery via said replaceable unit for producing the three-dimensional structure;

an electronic data processor for controlling said replaceable unit, said feeder, said at least one transport device and said delivery for producing the three-dimensional structure; and said replaceable unit being releasably mounted on said one of said stations of said machine frame for exchanging said replaceable unit with another replaceable unit selected from the group consisting of a printing unit operating in accordance with a second printing method, a substrate turning unit, a substrate further-transporting unit and a substrate perforating unit for producing the three-dimensional structure on the substrate.

2. System according to claim 1, wherein said replaceable unit is a plurality of units being mounted on and removed from each of said stations on said machine frame.

3. System according to claim 2, wherein said units for producing respective three-dimensional structures on a substrate are printing units operating in accordance with different printing methods.

4. System according to claim 3, wherein said printing units, respectively, are selected from the group consisting of ink jet, electrophotographic, offset and gravure printing units.

5. System according to claim 2, wherein said plurality of units are modular units having identical mounting parts for mounting said modular units on said machine frame.

6. System according to claim 2, wherein said plurality of units are modular units each having identical standard plug connectors for a power supply and a data exchange with said electronic data processor.

7. System according to claim 1, wherein said feeder and said delivery are removable from said machine frame, and including another machine frame being couplable therewith via said at least one of said turning unit and said further-transporting unit.

8. System according to claim 1, wherein said electronic data processor processes data representing the three-dimensional structures and is connected to said replaceable unit for producing a three-dimensional structure so that said replaceable unit receives the respective data from said electronic data processor for producing the three-dimensional structure based upon said data.

9. System for producing three-dimensional, imprinted structures on a substrate, comprising:

a sheet-fed printing press having a machine frame, said machine frame including a plurality of stations;

a plurality of replaceable modular units being mounted and removed from each of said stations on said machine frame, each of said replaceable modular units selected from the group consisting of a printing unit, a substrate turning unit, a substrate further-transporting unit and a substrate perforating unit mounted on one of said stations of said machine frame for producing a three-dimensional, imprinted structure on a substrate;

a feeder and a delivery for the substrate mounted on said machine frame;

at least one transport device mounted on said machine frame for transporting the substrate from said feeder to said delivery via said replaceable modular unit for producing the three-dimensional structure;

an electronic data processor for controlling said replaceable unit, said feeder, said at least one transport device and said delivery for producing the three-dimensional structure; and said plurality of replaceable modular units each having identical standard plug connectors for a power supply and a data exchange with said electronic data processor and being releasably mounted on said stations of said machine frame for exchanging one of said replaceable modular units with another one of said replaceable modular units selected from the group consisting of a printing unit, a substrate turning unit, a substrate further-transporting unit and a substrate perforating unit for producing the three-dimensional structure on the substrate.

10. System for producing three-dimensional, imprinted structures on a substrate, comprising:

a sheet-fed printing press having a machine frame, said machine frame including a plurality of stations;

a first replaceable printing unit operating in accordance with a first printing method and a second replaceable printing unit operating in accordance with a second printing method for producing a three-dimensional, imprinted structure on a substrate, said first replaceable printing unit releasably mounted on one of said stations of said machine frame for exchanging said first replaceable printing unit with said second replaceable printing unit;

a feeder and a delivery for the substrate mounted on said machine frame;

at least one transport device mounted on said machine frame for transporting the substrate from said feeder to said delivery via said first replaceable printing unit for producing the three-dimensional structure; and an electronic data processor for controlling said first replaceable printing unit, said feeder, said at least one transport device and said delivery for producing the three-dimensional structure.

* * * * *